United States Patent [19]

Quinlan et al.

[11] 4,120,654

[45] Oct. 17, 1978

[54] ALKYNOXYMETHYL AMINES AS CORROSION INHIBITORS

[75] Inventors: Patrick M. Quinlan, St. Louis, Mo.; Richard D. McBride, Arlington, Tex.

[73] Assignee: Petrolite Corporation, St. Louis, Mo.

[21] Appl. No.: 755,420

[22] Filed: Dec. 29, 1976

Related U.S. Application Data

[62] Division of Ser. No. 496,145, Aug. 9, 1974, Pat. No. 4,026,807.

[51] Int. Cl.[2] ..... C23F 9/00; C23F 9/02; C23F 11/10; C23G 1/02

[52] U.S. Cl. ..... 422/16; 134/3; 252/8.55 E; 252/390; 252/392; 260/563 R; 260/563 C; 260/570.9; 260/571; 260/573; 260/584 C

[58] Field of Search ..... 252/390, 392, 8.55 E; 21/2.7 R, 2.5 R; 134/3; 260/573, 584 C, 563 R, 563 C, 571, 570.9

[56] References Cited

U.S. PATENT DOCUMENTS

| | | | |
|---|---|---|---|
| 2,297,531 | 9/1942 | Bock | 260/584 C |
| 2,940,817 | 6/1960 | Browne | 260/563 R X |
| 3,335,089 | 8/1967 | Davidowich et al. | 21/2.7 R X |
| 3,335,090 | 8/1967 | Davidowich et al. | 21/2.7 R X |
| 3,337,469 | 8/1967 | Davidowich et al. | 21/2.7 R X |
| 3,337,470 | 8/1967 | Davidowich et al. | 21/2.7 R X |
| 4,026,807 | 5/1977 | Quinlan et al. | 260/584 C |
| 4,026,946 | 5/1977 | Quinlan | 260/584 C |

FOREIGN PATENT DOCUMENTS

| | | | |
|---|---|---|---|
| 1,474,514 | 3/1967 | France | 260/584 C |

OTHER PUBLICATIONS

Foster et al., "Industrial and Engineering Chemistry", vol. 51, No. 7, pp. 825–828 (1959).

*Primary Examiner*—Daniel E. Wyman
*Assistant Examiner*—John J. Doll
*Attorney, Agent, or Firm*—Sidney B. Ring; Hyman F. Glass

[57] ABSTRACT

This invention relates to alkynoxymethyl amines, to methods of preparing them, and uses thereof, particularly as corrosion inhibitors. These compounds are prepared by reacting an amine, such as $RNH_2$, with an aldehyde, such as formaldehyde, and an alkynol, such as propargyl alcohol, to yield compounds of the formula $$RN(CH_2OR')_2$$

where R is a substituted group, preferably alkyl, cycloalkyl, aryl, etc., and R′ is an acetylenic alcohol moiety.

7 Claims, No Drawings

ALKYNOXYMETHYL AMINES AS CORROSION INHIBITORS

This is a division of application Ser. No. 496,145, filed Aug. 9, 1974 now U.S. Pat. No. 4,026,807, issued May 31, 1977.

This invention relates to alknyoxymethyl amines, and most preferably bis(alkynoxymethyl) amines, and to uses for these compositions particularly as corrosion inhibitors.

The present invention may be ideally illustrated by the following equation $$RNH_2 + CH_2O + R'OH \rightarrow RN(CH_2OR')_2$$

where R is a substituted group, preferably hydrocarbon such as alkyl, aryl, cycloalkyl, etc. and substituted derivatives thereof, etc., and R' is an alkynyl moiety.

The reaction is carried out by reacting the amine, aldehyde, and acetylenic alcohol under dehydrating conditions. The alkynoxymethyl amine is formed. In practice the amine is gradually added to a mixture of formaldehyde and acetylenic alcohol in an azeotropic solvent at reflux until the theoretical amount of water is removed. Thereupon the product is separated from the reaction mixture, for example by distillation under reduced pressure.

A wide variety of amines having at least one primary group can be employed. They include aliphatic, cycloaliphatic, aryl, heterocyclic, etc. amines. These amines may or may not contain other groups. The following are representative examples.

n-Butyl amine
2-ethylhexyl amine
Monoisopropanolamine
Hexylamine
Heptylamine
Octylamine
Decylamine
Furfurylamine
Dodecylamine
Monoethanolamine
n-Amylamine
Sec-amylamine
2-amino-4-methylpentane
4-amino-2-butanol
5-isopropylamino-1-pentanol Also, high molecular weight aliphatic amines known as Armeen 10, Armeen 16D, Armeen HTD, Armeen 18D, and Armeen CD can be used. ($RNH_2$).

Amines having ring structures include cyclohexylamine, and various comparable amines with alkyl substitutents in the ring.

Similarly, an amine, presumably obtained from Rosin Amine D and acrylonitrile, can be prepared. The structure of Rosin Amine D is as follows:

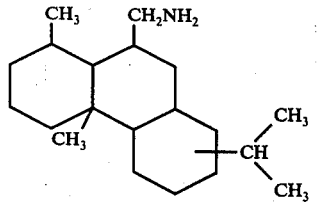

The acetylenic alcohols employed in the present invention may suitably include ethyl octynol, propargyl alcohol, hexynol and other acetylenic alcohols having the structural formula:

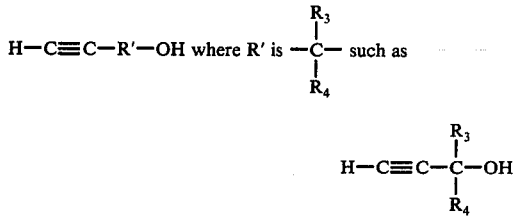

where $R_3$ is selected from the group consisting of $CH_3$ and H and $R_4$ is selected from the group consisting of hydrogen, alkyl groups having 1 to 18 carbon atoms, naphthalyl, phenyl, and alkyl substituted phenyls having 1 to 10 carbon atoms in the alkyl substituent. Examples of such alcohols include: methyl butynol, methyl pentynol, hexynol, ethyl octynol, propargyl alcohol, benzyl butynol, naphthalyl butynol, and the like. Acetylenic alcohols which contain 3 to 10 carbon atoms are preferred.

Although formaldehyde is preferred, other aldehydes or ketones may be employed in place of formaldehyde such as those of the formula

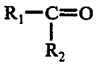

where $R_1$ and $R_2$ are hydrogen or a hydrocarbon group such as alkyl, i.e., methyl, ethyl, propyl, butyl, etc.; aryl, i.e., phenyl, alkyl phenyl, etc., benzyl; cycloalkyl, i.e., cyclohexyl, etc. Thus, the —$CH_2$— group in the formula $$RN(CH_2OR')_2$$

also may include substituted —$CH_2$— groups

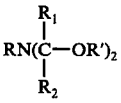

where the $R_1$ and $R_2$ are hydrogen or group derived from the aldehyde or ketone.

The following examples are illustrative.

EXAMPLE 1

Into a 500 ml. three-necked flask provided with a reflux condenser, stirrer, and a dropping funnel were placed 30.0 g. (1 mole) of paraformaldehyde, 57.0 g. (1 mole) of propargyl alcohol, and 100 ml. of benzene. The mixture was heated to reflux and 29.5 g. (0.5 mole) of isopropyl amine was added over a 30 minute period. A Barret type water separator was placed between the flask and the reflux condenser and refluxing was continued until the theoretical amount of water was removed azeotropically. Vacuum distillation of the products gave 45.0 g. (46%) of the desired product. It had the following structure:

$$C_3H_7N(CH_2O\ CH_2C{\equiv}CH)_2$$

Analysis for C H NO (195): % N calc. 7.18, % N found 7.39 % C calc. 67.69, % C found 67.40, % H calc. 8.71, % H found 9.07.

EXAMPLE 2

In a similar manner, 60.0 g. (2 mole) of paraformaldehyde, 114.0 g. (2 mole) propargyl alcohol and 73.0 g. (1 mole) of butyl amine were reacted together. Vacuum distillation of the products gave 141.0 g. (68%) of the desired compound. It had the following structure:

$C_4H_9N(CH_2O\ CH_2C{\equiv}CH)_2$

Analysis of C H NO (209): % N Calc. 6.68, % N found 6.81 % C Calc. 68.90, % C found 68.33, % H calc. 9.09, % H found 9.14.

EXAMPLE 3

In a similar manner, 95.5 g. (0.5 mole) of Primene 81-R, 30.0 g. (1 mole) of paraformaldehyde, and 57.0 g. (1 mole) of propargyl alcohol were reacted together. The product had the following structure:

$t\text{-}C_{12}H_{25}\text{-}C_{14}H_{29}N(CH_2O\ CH_2C{\equiv}CH)_2$

Analysis: % N calc. 4.3, % N found 5.1.

EXAMPLE 4

In a similar manner 129.0 g. (1 mole ) of t-octyl amine, 60.0 g. (2 mole) of paraformaldehyde, and 114.0 g (2 mole) of propargyl alcohol were reacted together. Vacuum distillation of the products gave 113 g. (42.5%) of the desired compound. It had the following structure:

$t\text{-}C_8H_{17}N(CH_2O\ CH_2C{\equiv}CH)_2$

Analysis for $C_{16}H_{27}NO_2$(265): % N calc. 5.28, % N found 5.30. % C calc. 72.45, % C found 72.14, % H calc. 10.19, % H found 10.39.

EXAMPLE 5

In a similar manner 107.0 g. (1 mole) of benzyl amine, 60.0 g. (2 mole) of paraformaldehyde, 114.0 g. (2 mole) of propargyl alcohol were reacted together. Vacuum distillation of the products gave 102 g. (42%) of the desired compound. It had the following structure:

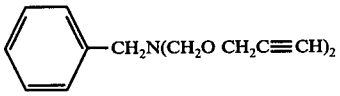

Analysis for $C_{15}H_{17}NO_2$(243): % N calc. 5.76, % N found 6.06. % C calc. 74.07, % C found 73.74. % H calc. 6.99, % H found 6.98.

EXAMPLE 6

In a similar manner 99.2 g. (1 mole) of cyclohexylamine, 60.0 g. (2 mole) of paraformaldehyde, and 114.0 g. (2 mole) of propargyl alcohol were reacted together. Vacuum distillation of the products gave 90.0 g. (38.3%) of the desired compound. It had the following structure:

Cyclohexyl-$N(CH_2O\ CH_2C{\equiv}CH)_2$

Analysis for $C_{14}H_{21}NO_2$ (235): % N calc. 5.95, % N found 5.96% C calc. 71.49, % C found 71.24 % H calc. 8.94, % H found 8.98.

EXAMPLE 7

In a similar manner 95.5 g. (0.5 mole) of Primene 81-R, 30.0 g. (1.0 mole) of paraformaldehyde, and 98.0 g. (1 mole) of Airco OW-1 (crude hexynol) were reacted together.

EXAMPLE 8

In a similar manner 126.0 g. (0.4 mole) of Primene JMT, 24.0 g. (0.8 mole) of paraformaldehyde, and 45.6 g. (0.8 mole) of propargyl alcohol were reacted together.

EXAMPLE 9

In a similar manner 105 g. (0.5 mole) of Armeen C, 30.0 g. (1 mole) of paraformaldehyde, and 57.0 g. (1 mole) of propargyl alcohol were reacted together.

EXAMPLE 10

In a similar manner 48.0 g. (0.25 mole) of Primene 81-R, 15.0 g. (0.5 mole) of paraformaldehyde, and 21.0 g. (0.5 mole) of 2-methyl-3-butyn-2-ol were reacted together.

Examples 7–10 yielded products corresponding to the formula $RN(CH_2OR')_2$.

In order to avoid repetitive detail the following table is presented to further illustrate examples of this invention.

Table 1

| | $RN(CH_2OR'C{\equiv}CH)_2$ | |
|---|---|---|
| | R | R' |
| Ex. 11 | $t\text{-}C_{12}H_{25}$ to $t\text{-}C_{14}H_{29}$ | $-\underset{\underset{CH_2CH_2CH_3}{\vert}}{\overset{H}{C}}-$ |
| Ex. 12 | $C_{12}H_{25}$ | $-\underset{\underset{(CH_2)_4CH_3}{\vert}}{\overset{H}{C}}-$ |
| Ex. 13 | $t\text{-}C_{12}H_{25}$ to $t\text{-}C_{14}H_{29}$ | $CH_3-(CH_2)_3-\underset{\underset{C_2H_5}{\vert}}{\overset{\overset{H}{\vert}}{C}H}-$ |
| Ex. 14 | $C_6H_{11}$ | $-\underset{\underset{(CH_2)_5-CH_3}{\vert}}{\overset{CH_3}{C}}-$ |
| Ex. 15 | $C_6H_5CH_2$ | $-\underset{\underset{CH_2CH_2CH_3}{\vert}}{\overset{H}{C}}-$ |
| Ex. 16 | $C_4H_9$ | $-\underset{\underset{(CH_2)_4CH_3}{\vert}}{\overset{H}{C}}-$ |

While the compounds of this invention may be isolated from the reaction mixture by vacuum distillation, in most cases it is more practical to use the reaction mixtures, as is, in the practice of this invention.

USES

This invention also relates to the inhibition of corrosion, particularly the corrosion of metals in contact with the acid solutions.

The present invention is especially useful in the acidizing or treating of earth formations and wells traversed by a bore hole. It may also be used in metal cleaning and pickling baths which generally comprise aqueous solutions of inorganic acids such as sulfuric acid, hydrochloric acid, phosphoric acid and are useful in the cleaning and treatment of iron, zinc, ferrous alloys, and the like.

If no corrosion inhibitor is present when the aqueous acidic solution comes in contact with the metal, excessive metal loss and consumption or loss of acid, and other adverse results will be experienced. There has been a continuing search for corrosion inhibitors which can be used effectively in small concentrations, and which are economical to produce. The need is also for corrosion inhibitors which are effective at high temperatures, e.g., 200° F. and above, such as are found in operations involving acidic solutions, particularly oil-well acidizing where higher and higher temperatures are found as the well extends further into the earth.

While the compounds of this invention are of themselves particularly good acid corrosion inhibitors, optionally they may be blended with acetylenic alcohols, dispersing and solubilizing agents such as ethoxylated phenols, alcohols, and fatty acids. They may also be blended with such know acid inhibitors as the quinoline or alkyl pyridine quaternary compounds or synergists such as terpene alcohols, formamide, formic acid, alkyl amine, alkylene polyamines, heterocyclic amines, and the like.

Quaternary ammonium compounds may be illustrated by C-alkyl pyridine-N-methyl chloride quaternary, C-alkyl pyridine-N-benzyl chloride quaternary, quinoline-N-benzyl chloride quaternary, isoquinoline-N-benzyl chloride quaternary, thioalkyl pyridine quaternaries, thioquinoline quaternaries, benzoquinoline quaternaries, thiobenzoquinoline quaternaries, imidazole quaternaries, pyrimidine quaternaries, carbazole quaternaries, the corresponding ammonium compounds, pyridines and quinolines may also be used alone or in combination with the quaternary compounds. Thus a pyridine plus quinoline quaternary, a quinoline plus quinoline quaternary, or quinoline or amine alone or in combination may be used.

The formic acid compound may be selected from the esters and amides of formic acid. The formic acid compound may be from the group consisting of formate esters of the structure:

HCOOR where R is a monoaryl group, an alkyl group having 1 to 6 carbon atoms, cyclo-alkyl residues having 5 to 6 carbon atoms, alkenyl and alkynl groups having 2 to 6 carbon atoms which may contain functional groupings selected from —C—OH, —OH, =C=O, —COOH, —SH, and $NH_2$. Examples of the formic acid compound are: methyl formate, ethyl-formate, benzyl formate, other alkyl and aryl formates, and the like. Other examples include formamide, dimethyl formamide, formanilide, and the like. Mixtures of the esters and mixtures of the amides may be used.

An alkanol may also be employed in the composition as a solvent as illustrated by methyl, ethyl, propyl, isopropyl, butyl, pentyl, hexyl, heptyl, octyl, and the higher liquid members of these aliphatic alcohols.

USE IN FLUIDS FOR DRILLING WELLS

This phase of the invention relates to the use of the compounds of this invention as corrosion inhibitors in producing an improved drilling fluid useful in drilling oil and gas wells.

Fluids commonly used for the drilling of oil and gas wells are of two general types: water-base drilling fluids comprising, for example, a clay suspended in water, and oil-base drilling fluids comprising, for example, a clay or calcium carbonate suspended in mineral oil.

A third type of drilling fluid which has recently been developed, is one of oil-in-water or water-in-oil emulsion, for example, emulsions of mineral oil in water or water in mineral oil formed by means of emulsifiers such as sulfuric acid; Turkey-red oil; soaps of fatty acids, for example, sodium oleate; emulsoid colloids, for example, starch, sodium alginate, etc. Varying amounts of finely divided clay, silica, calcium carbonate, blown asphalt and other materials may be added to these emulsions to improve their properties and control their weight.

I have now discovered that the compositions of this invention can be employed as a corrosion inhibitor in drilling fluids.

USE IN AIR DRILLING

It has long been conventional practice in drilling deep bore holes to circulate a drilling mud down through the drill stem and up through the bore hole between the wall of the bore hole and the drill stem for the removal of chips or cuttings from the bore hole and to provide support for the wall of the bore hole. More recently, in the drilling of holes in which wall support provided by drilling mud is not employed, drilling has been carried out with the use of air for chip removal. Such drilling is not only normally faster than mud drilling but is indispensible in areas where the supply of water is limited or when drilling through cavernous formations into which the drilling mud flows and becomes lost.

The increasing popularity of air or gas drilling has come about not only because this method of drilling is frequently faster, as noted above, but for the additional reasons that the drill bits last longer, the provision and handling of water under wide ranges of temperature conditions is avoided, boring samples are easily observed when they are not mixed with mud, and there is no loss involved as in the case of mud drilling when drilling through cavernous formations. Furthermore, prompt removal of water entering the hole maintains a dry hole and the likelihood of wall collapse is thereby reduced.

In a typical air drilling operation there may be provided, for example, an up-flow of air in the bore hole having a velocity of the order of 3,000 feet per minute. This flow of air upwardly through the bore hole, which is produced by air pumped downwardly through the drill stem, provides adequate removal of cuttings. The air is delivered to the drill stem at pressures of 20 to 60 lbs. per square inch and for dewatering or for breaking obstructions, as will be hereinafter described, the pressures may be increased to 180 to 200 lbs. or more per square inch.

Air drilling operations are frequently hampered by the inflow of water into the bore hole when the drill bit is penetrating a water bearing stratum or when the bore hole has passed through a water bearing stratum that has not been cased. Normally, if drilling proceeds uninterruptedly both before and during penetration into a water bearing stratum, the flow of air is sufficient to blow the water out of the bore hole along with the cuttings and drilling dirt. There are, however, two major problems encountered in air drilling when water is entering the bore hole. The first problem occurs when there is a small inflow of water sufficient to cause a dampening of the cuttings which, under certain conditions, will then ball-up, clogging and sometimes jamming the drill bit. The second problem is encountered when there is a substantial amount of water remaining in the bottom of the bore hole during drilling causing a sloughing of the side wall of the bore hole. This latter condition may arise even though the water entering the bore hole is being blown out of the hole as fast as it enters. If there is a substantial inflow of water or if there is a substantial flow of water past a region of the bore hole susceptible to this condition, the water passing that region of the bore hole may cause a sloughing of the side wall.

The addition of foam forming materials to the air flow when air drilling is employed in conjunction with sufficient water to provide foaming gives rise to numerous advantages in drilling operations. The water may be introduced either through a water bearing stratum being penetrated by the drill bit or, alternatively, if the hole is dry, water may be introduced from the surface of the earth through the drill stem in conjunction with the delivery of compressed air and foam forming material through the drill stem to the drill bit. In either case the water may be said to be existing in the bore hole, and drilling operations are described in U.S. Pat. No. 3,130,798.

The amount of the compositions of the invention to be employed as a corrosion inhibitor can vary widely depending upon particular compounds, the particular system, the amounts of oxygen present, etc. I may employ concentrations of from about 0.5 to 5,000 p.p.m., such as from about 4 to 4,000 p.p.m., for example from about 20 to 2,000 p.p.m., but preferably from about 100 to 1,000 p.p.m. The optimum amount, to be determined in each instance, which will depend on function and economics, can be lesser or greater than the above amounts under proper conditions.

USE IN BRINES

This phase of the invention relates to the prevention of corrosion in systems containing a corrosive aqueous medium, and most particularly in systems containing brines.

More particularly, this invention relates to the prevention of corrosion in the secondary recovery of petroleum by water flooding and in the disposal of waste water and brine from oil and gas wells. Still more particularly, this invention relates to a process of preventing corrosion in water flooding and in the disposal of waste water and brine from oil and gas wells which is characterized by injecting into an underground formation an aqueous solution containing minor amounts of compositions of this invention, in sufficient amounts to prevent the corrosion of metals employed in such operation. This invention also relates to corrosion inhibited brine solutions of these compounds.

When an oil well ceases to flow by the natural pressure in the formation and/or substantial quantities of oil can no longer be obtained by the usual pumping methods, various processes are sometimes used for the treatment of the oil-bearing formation in order to increase the flow of the oil. These processes are usually described as secondary recovery processes. One such process which is used quite frequently is the water flooding process wherein water is pumped under pressure into what is called an "injections well" and oil, along with quantities of water, that have been displaced from the formation, are pumped out of an adjacent well usually referred to as a "producing well." The oil which is pumped from the producing well is then separated from the water that has been pumped from the producing well and the water is pumped to a storage reservoir from which it can again be pumped into the injection well. Supplementary water from other sources may also be used in conjunction with the produced water. When the storage reservoir is open to the atmosphere and the oil is subject to aeration this type of water flooding system is referred to herein as an "open water flooding system." If the water is recirculated in a closed system without substantial aeration, the secondary recovery method is referred to herein as a "closed water flooding system."

Because of the corrosive nature of oil field brines, to economically produce oil by water flooding, it is necessary to prevent or reduce corrosion since corrosion increases the cost thereof by making it necessary to repair and replace such equipment at frequent intervals.

I have now discovered a method of preventing corrosion in systems containing a corrosive aqueous media, and most particularly in systems containing brines, which is characterized by employing the compositions of this invention.

I have also discovered an improved process of protecting from corrosion metallic equipment employed in secondary oil recovery by water flooding such as injection wells, transmission lines, filters, meters, storage tanks, and other metallic implements employed therein and particularly those containing iron, steel, and ferrous alloys, such process being characterized by employing in water flood operation the compositions of this invention.

This phase of the invention then is particularly concerned with preventing corrosion in a water flooding process characterized by the flooding medium containing an aqueous or an oil field brine solution of these compounds.

In many oil fields large volumes of water are produced and must be disposed of where water flooding operations are not in use or where water flooding operations cannot handle the amount of produced water. Most States have laws restricting pollution of streams and land with produced waters, and oil producers must then find some method of disposing of the waste produced salt water. In many instances, therefore, the salt water is disposed of by injecting the water into permeable low pressure strata below the fresh water level. The formation into which the water is injected is not the oil producing formation and this type of disposal is defined as salt water disposal or waste water disposal. The problems of corrosion of equipment are analagous to those encountered in the secondary recovery operation by water flooding.

The compositions of this invention can also be used in such water disposal wells thus providing a simple and economical method of solving the corrosion problems encountered in disposing of unwanted water.

Water flood and waste disposal operations are too well known to require further elaboration. In essence, in the present process, the flooding operation is effected in the conventional manner except that the flooding medium contains a minor amount of the compound of this invention, sufficient to prevent corrosion, in concentrations of about 10 p.p.m. to 10,000 p.p.m., or more, for example, about 50 to 5,000 p.p.m., but preferably about 15 to 1,500 p.p.m. The upper limiting amount of the compounds is determined by economic considerations. Since the success of a water flooding operation manifestly depends upon its total cost being less than the value of the additional oil recovered from the oil reservoir, it is quite important to use as little as possible of these compounds consistent with optimum corrosion inhibition. Optimum performance is generally obtained employing about 1,000 p.p.m. Since these compounds are themselves inexpensive and are used in low concentrations, they enhance the success of a flood operation by lowering the cost thereof.

In addition, these compounds are not sensitive to oxygen content of the water and these are effective corrosion inhibitors in both open water flooding systems and closed water flooding systems.

While the flooding medium employed in accordance with the present invention contains water or oil field brine and the compounds, the medium may also contain other materials. For example, the flooding medium may also contain other agents such as surface active agents or detergents which aid in wetting throughout the system and also promote the desorption of residual oil from the formation, sequestering agents which prevent the deposition of calcium and/or magnesium compounds in the interstices of the formation, bactericides which prevent the formation from becoming plugged through bacterial growth, tracers, etc. Similarly, they may be employed in conjunction with any of the operating techniques commonly employed in water flooding and water disposal processes, for example five spot flooding, peripheral flooding, etc., and in conjunction with other secondary recovery methods.

USE IN ACID SYSTEMS

The compounds of this invention can also be employed as corrosion inhibitors for acid systems, for example as illustrated by the pickling of ferrous metals, the treatment of calcareous earth formations, etc., as described in the following sections.

USE AS PICKLING INHIBITORS

This phase of the invention relates to pickling. More particularly, the invention is directed to a pickling composition and to a method of pickling ferrous metal. The term "ferrous metal" as used herein refers to iron, iron alloys and steel.

To prepare ferrous metal sheet, strip, etc. for subsequent processing, it is frequently desirable to remove oxide coating, formed during manufacturing, from the surface. The presence of oxide coating, referred to as "scale" is objectionable when the material is to undergo subsequent processing. Thus, for example, oxide scale must be removed and a clean surface provided if satisfactory results are to be obtained from hot rolled sheet and strip in any operation involving deformation of the product. Similarly, steel prepared for drawing must possess a clean surface and removal of the oxide scale therefrom is essential since the scale tends to shorten drawing-die life as well as destroy the surface smoothness of the finished product. Oxide removal from sheet or strip is also necessary prior to coating operations to permit proper alloying or adherence of the coating to the ferrous metal strip or sheet. Prior to cold reduction, it is necessary that the oxide formed during hot rolling be completely removed to preclude surface irregularities and enable uniform reduction of the work.

The chemical process used to remove oxide from metal surfaces is referred to as "pickling." Typical pickling processes involve the use of aqueous acid solutions, usually inorganic acids, into which the metal article is immersed. The acid solution reacts with the oxides to form water and a salt of the acid. A common problem in this process is "overpickling" which is a condition resulting when the ferrous metal remains in the pickling solution after the oxide scale is removed from the surface and the pickling solution reacts with the ferrous base metal. An additional difficulty in pickling results from the liberated hydrogen being absorbed by the base metal and causing hydrogen embrittlement. To overcome the aforementioned problems in pickling, it has been customary to add corrosion inhibitors to the pickling solution.

The present invention avoids the above-described problems in pickling ferrous metal articles and provides a pickling composition which minimizes corrosion, overpickling and hydrogen embrittlement. Thus the pickling inhibitors described herein not only prevent excessive dissolution of the ferrous base metal but effectively limit the amount of hydrogen absorption thereby during pickling. According to the invention, a pickling composition for ferrous metal is provided which comprises a pickling acid such as sulfuric or hydrochloric acid and a small but effective amount of the compounds of this invention, for example at least about 5 p.p.m., such as from about 100 to 10,000 p.p.m., but preferably from about 3,000 to 7,000 p.p.m.

Ferrous metal articles are pickled by contacting the surface (usually by immersion in the pickling solution) with a pickling composition as described to remove oxide from their surface with minimum dissolution and hydrogen embrittlement thereof and then washing the ferrous metal to remove the pickling composition therefrom.

USE IN ACIDIZING EARTH FORMATIONS

The compositions of this invention can also be used as corrosion inhibitors in acidizing media employed in the treatment of deep wells to reverse the production of petroleum or gas therefrom and more particularly to an improved method of acidizing a calcareous or magnesium oilbearing formation.

It is well known that production of petroleum or gas from a limestone, dolomite, or other calcareous-magnesian formation can be stimulated by introducing an acid into the producing well and forcing it into the oil or gas bearing formation. The treating acid, commonly a mineral acid such as HCl, is capable of forming water soluble salts upon contact with the formation and is effective to increase the permeability thereof and augment the flow of petroleum to the producing well.

CORROSION TEST PROCEDURE

In these tests the acid solutions were mixed by diluting concentrated hydrochloric acid with water to the desired concentrations.

Corrosion coupons of N-80 steel (ASTM) were pickled in an uninhibited 10% HCl solution for 10 minutes, neutralized in a 10% solution of $NaHCO_3$, dipped in acetone to remove water and allowed to dry. They were then weighed to the nearest milligram and stored in a desicator.

In most of the tests, a 25cc/in$^2$ acid volume to coupon surface area ratio was used. After the desired amount of acid was poured into glass bottles, the inhibitor was added. The inhibited acid solution was the placed in a water bath which had been set at a predetermined temperature and allowed to preheat for 20 minutes. After which time, the coupons were placed in the preheated inhibited acid solutions. The coupons were left in the acid solutions for the specified test time, then removed, neutralized, recleaned, rinsed, dipped in acetone, allowed to dry, then reweighed.

The loss in weight in grams was multiplied times a calculated factor to convert the loss in weight to lbs./ft$^2$/24 hrs. The factor was calculated as follows:

$$\frac{\frac{144\ \text{in}^2}{\text{ft}^2}}{\frac{454\ \text{g}}{\text{lb}} \times \text{Surface Area of Coupon (in}^2) \times \frac{1\ \text{day}}{24\ \text{hrs.}}} = \text{Factor}$$

The results of these tests are included below:

| Inhibitor | Conc. in gals/1000 gals acid | Test Temp. ° F. | Test Time Hrs. | Acid | Metal Type | Corrosion Rate (lbs./ft$^2$/day |
|---|---|---|---|---|---|---|
| Ex. 3 | 6.0 | 200 | 4 | 15%HCl | n-80 | 0.055 |
| Ex. 4 | 6.0 | 200 | 4 | 15%HCl | n-80 | 0.549 |
| Ex. 5 | 6.0 | 200 | 4 | 15%HCl | N-80 | 0.418 |
| Ex. 6 | 6.0 | 200 | 4 | 15%HCl | N-80 | 0.341 |
| Ex. 7 | 6.0 | 200 | 4 | 15%HCl | N-80 | 0.048 |
| Ex. 8 | 6.0 | 200 | 4 | 15%HCl | N-80 | 0.542 |
| Ex. 9 | 6.0 | 200 | 4 | 15%HCl | N-80 | 0.188 |
| Ex. 11 | 6.0 | 200 | 4 | 15%HCl | N-80 | 0.045 |
| Blank | | 200 | 4 | 15%HCl | N-80 | 2.32 |

Applications in which the inhibitors of the present invention are particularly useful include oil-well acidizing solutions, metal pickling, cleaning and polishing baths, boiler cleaning compositions and the like. They are also useful as oil soluble corrosion inhibitors, bactericides, water-in-oil demulsifying agents, surfactants and the like.

In summary, the present invention relates to compounds of the formula $$RN(CH_2OR')_2$$

where R is a substituted group preferably hydrocarbons such as alkyl, cycloalkyl, aryl, etc., and substituted derivatives thereof, having 1–30 carbons and preferably 3–18 carbons; where R′ is an acetylenic moiety preferably propargyl or a crude propargyl mixture having from 3–10 carbons. If an aldehyde or ketone other than formaldehyde is employed, the $CH_2$ group will be substituted. These compounds are employed for many uses but preferably a corrosion inhibitor preferably in acid systems in amounts sufficient to inhibit corrosion, such as from 1 to 10,000 ppm, such as from 50–8,000 ppm, but preferably from 3,000 to 7,000 ppm.

We claim:

1. A process of inhibiting corrosion of metals in contact with aqueous or oil-based acid systems which comprises adding to said system a small amount effective to inhibit the corrosion of said metals of a compound of the formula $$RN(CH_2\text{-}OR')_2$$

where R is a hydrocarbon group and R′ is an acetylenic moiety.

2. The process of claim 1 where R in the compound is alkyl, cycloalkyl, or aryl.

3. The process of claim 2 where R in the compound is alkyl.

4. The process of claim 3 wherein the R′ in the compound is propargyl.

5. The process of claim 4 where R in the compound is t-$C_{12}H_{25}$ to t-$C_{14}H_{29}$.

6. The process of claim 1 where the alkynoxymethyl amine corrosion inhibitor is added in the amount of 1 p.p.m. to 10,000 p.p.m. of inhibitor of acid system.

7. The process of claim 1 where the amount of alkynoxymethyl amine corrosion inhibitor is added in the amount of 3,000 p.p.m. to 7,000 p.p.m. of acid system.

* * * * *